United States Patent [19]

McGary

[11] 4,067,221

[45] Jan. 10, 1978

[54] SOLDER RECOVERY SYSTEM

[76] Inventor: Willard Graydon McGary, 8261-4th Northeast, Seattle, Wash. 98115

[21] Appl. No.: 643,188

[22] Filed: Dec. 22, 1975

[51] Int. Cl.[2] ..... B22C 23/00

[52] U.S. Cl. ..... 72/263; 29/403

[58] Field of Search ..... 72/263

[56] References Cited

U.S. PATENT DOCUMENTS

| | | | |
|---|---|---|---|
| Re. 21,378 | 3/1940 | Friden | 72/263 |
| 3,478,561 | 11/1969 | Samuel | 72/263 |
| 3,638,469 | 2/1972 | Allen | 72/263 |
| 3,898,831 | 8/1975 | Kahlefeld | 72/263 |

*Primary Examiner*—C.W. Lanham
*Assistant Examiner*—V. Rising

[57] ABSTRACT

A method and apparatus for recovering and reusing solder following the removal from radiators or the like requiring repair. The solder is melted or otherwise removed from the radiator core, heated, formed into billets, trimmed to remove foreign particles and then placed into a short stroke extruding machine forming the solder into a continuous strand which is coiled and reused. To achieve the maximum stroke with the minimum space the extruding mechanism includes a pivotably mounted ram within a framework adjacent the die chamber and includes as an integral portion thereof a particularly designed trunnion having an elongated hole to receive the bearing and a flat portion whereby the full extrusion force is absorbed by the end plate of the framework without undue stress being placed upon the bearing itself.

4 Claims, 8 Drawing Figures

SOLDER RECOVERY SYSTEM

BACKGROUND OF THE INVENTION

As is well known, the cooling system for most internal combustion engines includes a radiator, water pump and the necessary conduits to carry the cooling fluid to and from the engine itself. Since it is desirable to keep the amount of fluid at a minimum the radiator has been specifically designed to capture the flow of air and utilize it to its maximum to cool the fluid passing therethrough. Because of the desire for maximum cooling effect of the flowing air, the radiator core contains a plurality of small conduits to carry the cooling fluid which have air channels thereby. To increase the efficiency of cooling, the conduits within the radiator which carry the fluid are extremely thin walled and thus subject to leakage.

The initial and replacement cost of a radiator can be substantial and therefore an industry has been built upon the necessity and desirability of repairing radiator cores. Traditionally, for reasons of economy, the repair of a radiator has been accomplished by utilizing a high intensity heat source to remove all solder upon the radiator whether placed there during construction or previous repair. There has been no attempt made to collect or reuse the solder removed since it was allowed to fall upon the floor and thus it was most economical to simply sweep up the particles and deposit them in a suitable trash receptable along with the other debris. With the ever increasing cost of basic materials as well as the concern over total shortage of materials it has become imperative that the solder removed be reclaimed and reused.

It is acknowledged that the standard method of producing a strand of solder is to utilize a billet of the prescribed combination of components and then extrude the billet into a continuous strand which is wrapped upon spools of suitable size. These known prior art devices are for obvious reasons such as economy and efficiency, extremely large, utilize a long stroke and usually operate upon a horizontal bed. Since the known devices operate on a horizontal bed it is possible to place the ram and its operating mechanism upon a truck of some nature such that the ram can be completely extracted from the die chamber to accommodate the insertion of another billet. Whereas this method is economical and feasible when the extruder is in continuous or almost continuous operation the utilization of an apparatus of this type for the recovery within a small radiator repair shop is impractical both from the expense and from the unwarranted use of space standpoint.

Thus, as can be readily seen it is desirable to have a small extrusion mechanism which is capable of providing the pressures necessary to extrude the solder into a continuous strand for use in a small radiator repair shop. Such a mechanism must be one which does not require sophisticated equipment, sophisticated handling, and/or a great deal of space and auxiliary equipment.

With this in mind, it is an object of the present invention to provide a method of fabricating a continuous solder strand including the steps of removing the solder from the apparatus to which it was previously secured, collecting the particles of solder, melting the solder and forming it into a billet of a predetermined dimension, trimming the billet, thereby removing any and all foreign particles, extruding the billet into a continuous strand and coiling the billet on a suitable spool.

Another object of the present invention is to provide a small, economical and easily used extruding mechanism comprising a die chamber to receive the billet and a ram which is pivotally mounted to permit the ram to be pivoted through an arc away from the mouth of the die chamber to allow the insertion of another billet to be extruded.

Yet another object of the present invention is to provide a source of fluid under pressure to simultaneously drive an extrusion ram for forming a continuous strand of solder and a trimming knife which removes the end of the next billet to be extruded thereby removing all impurities.

It is still another object of the present invention to provide a powered coiling mechanism which is operated by fluid under pressure provided by a common source such that the billet can be trimmed, the solder extruded and the extruded solder coiled upon a suitable spool simultaneously thereby greatly decreasing the amount of space, and/or storage necessary for the operation.

Still another object of the present invention is to provide a novel extrusion mechanism wherein the ram is pivotally mounted in a vertical orientation. The pivot is located at the upper end and said ram is mounted directly above the die chamber which is to receive the billet to be extruded. The extruding ram includes a novel mounting including a trunnion mounted in elongated bearings such that vertical movement of the ram results upon the extrusion stroke. The uppermost portion of the extruding ram includes a flattened surface which reacts against an end plate of the encompassing framework whereby all of the pressure is transferred directly to the end plate without undue stress and resultant damage to the trunnions themselves.

Still a further object of the present invention is to provide a die which comprises a pair of truncated cones in a top to top relationship whereby the solder when extruded will be of the desired size and will have a smooth, shiny and desirable exterior surface.

Still another object of the present invention is to provide an extruding mechanism wherein the extruding ram has a configured end such that the solder billet when extruded forms a sealing ring around the rim preventing further upward flow of the solder thereby lessening the down time as well as the frequency at which the device must be cleaned.

DETAILED DESCRIPTION OF DRAWINGS

Figure 1:
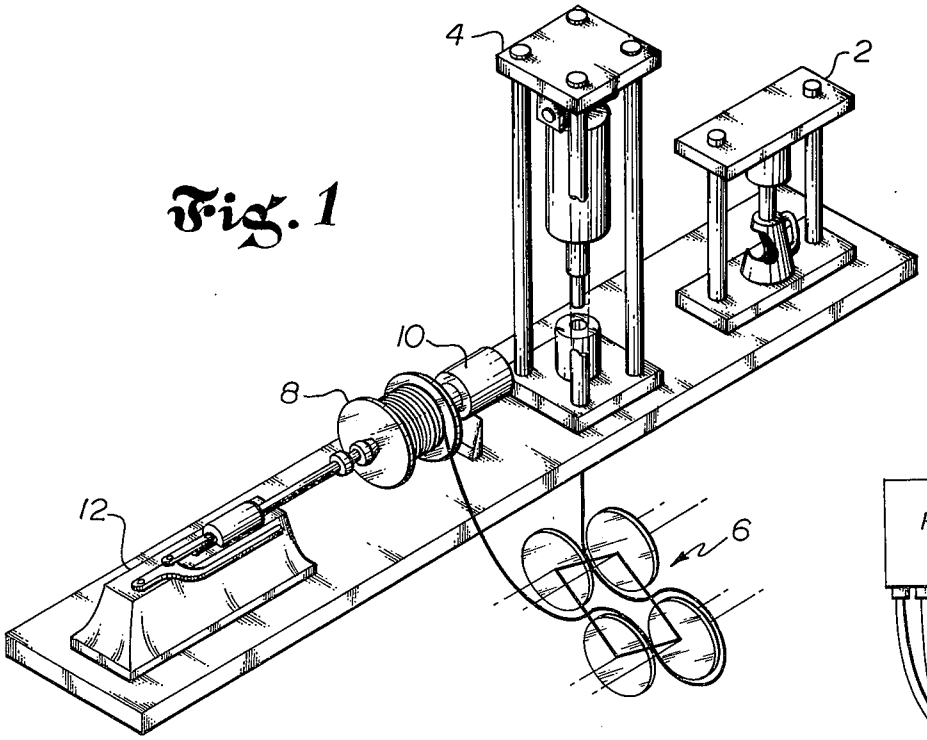
FIG. 1 is a pictoral representation of the mechanism necessary for the inventive recovery system.

As seen in FIG. 1, the inventive method and apparatus includes a plurality of interdependent and interrelated machines. The premolded billet is trimmed to remove any impurities in the automatic trimming mechanism designated generally as 2. Following the trimming the billet is placed in the extruding mechanism designated generally as 4 and extruded out the bottom of said mechanism, fed over a pulley wheel 6 and wrapped upon a spool 8 by means of motor 10 and clamping mechanism 12. Each of the elements 2, 4 and 10 are operated by fluid under pressure from a single source and, therefore, interconnected and simultaneously controlled by an operator.

Figure 2:
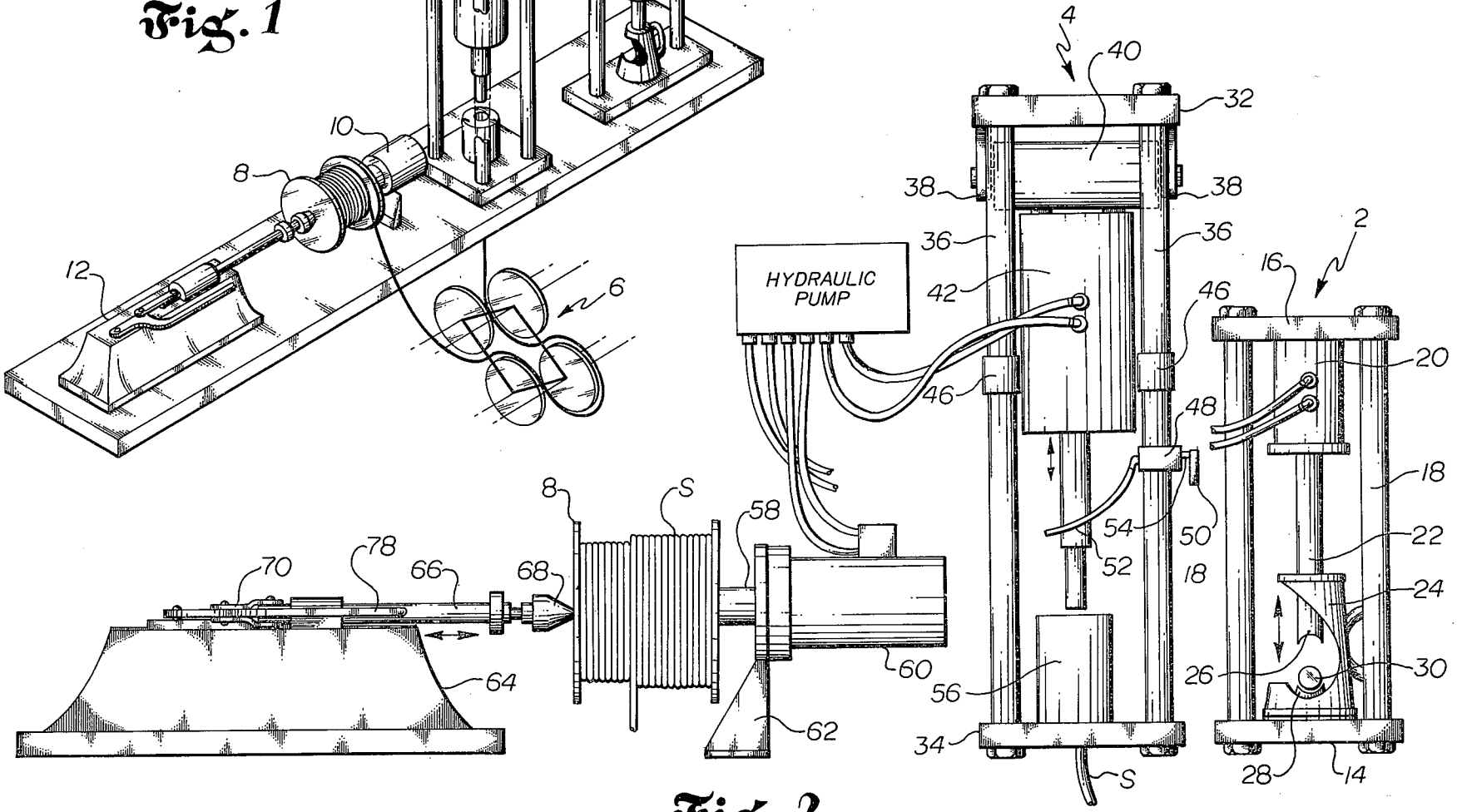
FIG. 2 is an elevational view of the three main elements necessary for the inventive recovery system.

As more clearly seen in FIG. 2, the trimming mechanism 2 includes a rigid base plate member 14 and a similar rigid top member 16 rigidly interconnected and spaced by means of two interconnecting rods 18, one at each corner. Rigidly mounted to the upper plate 16 is a double acting hydraulic ram 20 having an outwardly extending shaft 22. Mounted to the bottom plate 14 is an anvil structure having main body portion 24 having reciprocably mounted therein a guillotine-type trimming blade 26 controlled by the shaft 22. Mounted directly below the guillotine blade 26 is the anvil element 28 upon which the billet of solder 30 rests during the trimming process. As noted above, the solder scraps are melted and molded into billets and the foreign particle matter rises to the top of the billet during the solidifying process. In order to have a usable strand of solder, the impurities must be removed, and this is accomplished by trimming prior to the extrusion process which will be described hereinafter.

The extrusion mechanism itself herein generally designated as 4 is similar to the trimming mechanism in that it includes a rigid upper plate member 32, a rigid lower plate member 34, and had plate members 32 and 34 interconnected by four vertical rods 36 such that the plates are rigidly held in proper relative position both during extrusion and rest. Extending downwardly from opposite sides of upper plate member 32 are a pair of trunnions 38 which have mounted therebetween a horizontally displaced shaft member 40. The interconnection and shaft mechanism per se are described in greater detail hereinafter. Pivotally mounted to the shaft member 40 is a double acting ram 42 having an outwardly extending shaft 44. As noted above, the ram 42 is rigidly mounted to the rod 40 which is pivotally mounted between the trunnions and is properly located in position for extrusion by means of locaters or bumper members 46 mounted upon two of the vertical rods 36. For ease in moving the shaft 44 from its driving or extrusion position to a position somewhat removed for insertion of a new billet a control device is provided. The control device is mounted to leg 36 and includes a securing collar 48, a handle 50, and a shaft contacting arm 52. Handle 50 and shaft contacting arm 52 are interconnected by means of a horizontal rod or shaft 54 rigidly connected to both the handle and the shaft contacting means 52. Movement of the handle thereby results in movement of the shaft contacting arm 52 and thus controls the location or placement of the two-way ram 42 and its operating shaft. As will be explained hereinafter the shaft can be pivoted out of alignment with the extrusion dye chamber 56 to permit insertion of another billet. As noted in this figure the extruded solder S exits from the bottom of the dye chamber through a hole bored in bottom plate 44.

As seen in FIG. 1, the extruded solder is, for purposes of convenience, threaded over at least one pulley wheel 6 and then returned to the work bench whereat it is coiled upon a removable spool 8. Removable spool 8 is then, with its coiled solder easily moved to the place of desired use.

Referring again to FIG. 2, the spool 8 is mounted upon a horizontal shaft or spindle 58 which is in turn directly connected to a fluid motor 60, in turn mounted to a bench or the like by means of supporting stand 62. The reel 8 is held in position upon the shaft 58 of motor 60 by means of a clamping mechanism which comprises a base member 64 secured to the supporting surface. The base member has mounted thereon a horizontally movable shaft 66 having a reel engaging conically shaped nose portion 68 which is moved into and out of contact with the reel 8 by means of toggle mechanism 70 and control handle 78, better seen in FIG. 7.

Figures 3, 4, 5, 6:
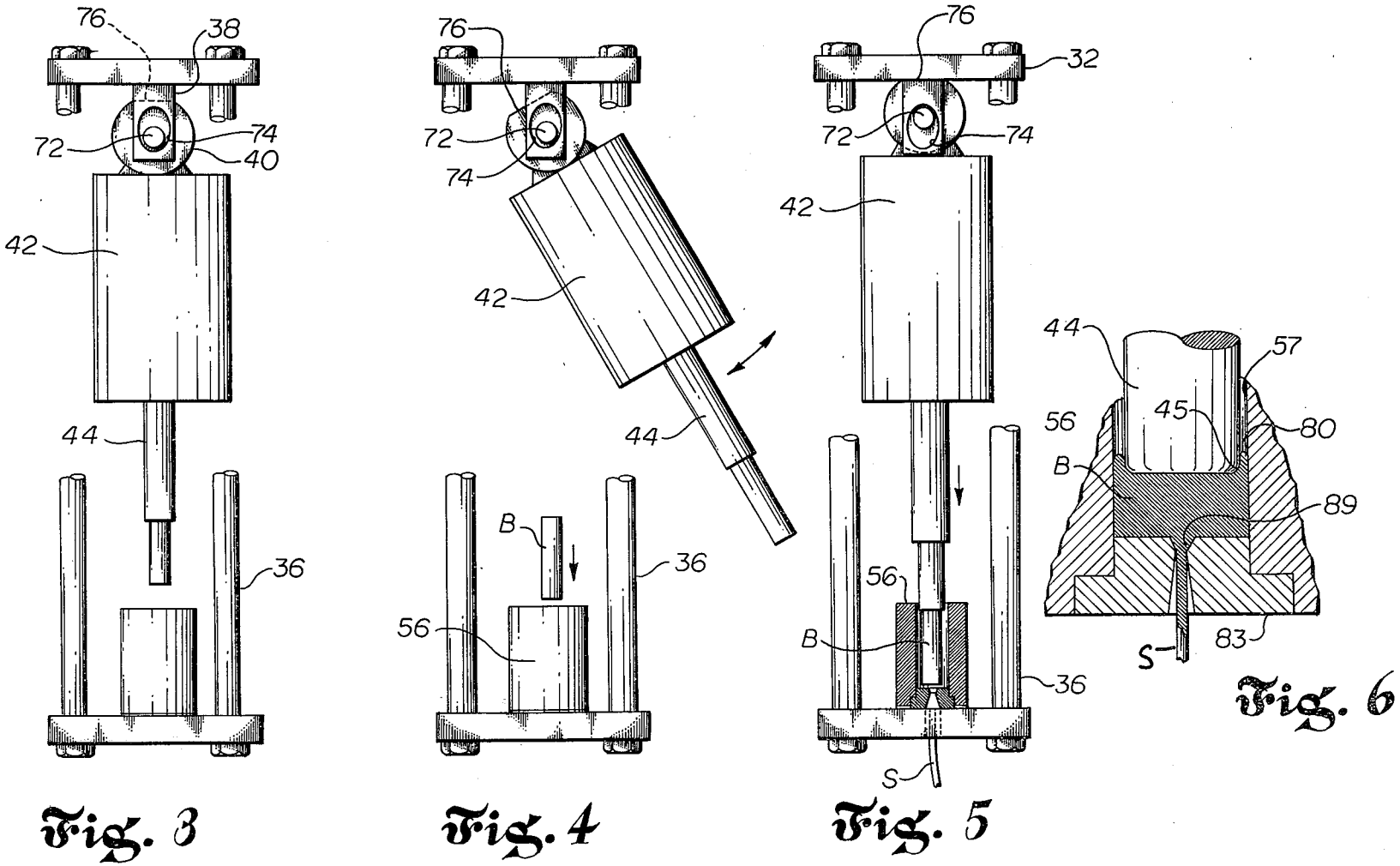
FIG. 3 is an elevational view of the novel extruding apparatus in its ready position.
FIG. 4 is an elevational view of the novel extruding apparatus with the ram pivoted to permit placement of the billet.
FIG. 5 is an elevational view of the novel extruding ram, partially in section, showing the ram during the extrusion process.
FIG. 6 is an enlarged view of the die and the head of the extrusion ram.

Referring now to FIGS. 3, 4 and 5, the operation of the extrusion mechanism 2 can more easily be seen. As seen, the double acting ram 42 is mounted to horizontal rod 40 having outwardly extending from the ends thereof bearing members 72 which extend through trunnions 38 having elongated shaped bores 74 therein. The top portion of rod 40 is flattened as at 76 for purposes explained hereinafter. As can be seen in FIG. 3, when the hydraulic ram is in its retracted position the weight of the ram and its shaft 44 are supported by the contact between the bearing 72 and the bottom of the opening 74.

Referring now to FIG. 4, in particular, the ram 42 is pivoted such that a billet B may be inserted into the chamber 56. Again as can be seen, the ram is supported by means of bearing 72 at the lower end of the elliptical or elongated hole 74.

During the actual extrusion processes, depicted in FIG. 5, the shaft 44 is now in contact with a billet B within the chamber 56 and the double acting ram 42 has been forced upwardly such that the flat portion 76 is in contact with the upper plate 32 removing all strain from the bearing member 72 which is moved upwardly within the elongated bore 74.

An enlarged view of the lower end of the ram in the die cavity 57 is shown in FIG. 6. As seen in this view the billet B in addition to being extruded as solder S, has formed an upwardly extending collar or seal 80 surrounding shaft 44. The lower curved or rounded configuration 45 of the edges of the ram 44 cause the solder to flow upwardly and outwardly forming a self-sealing collar 80. One of the problems which was apparent in the early utilization of the present method was that the strand solder was not the bright shiny solder that the intended purchasers were expecting. To generate the shiny strand necessary for sales purposes the extrusion die 83 has an inwardly tapered conical entry section 89 and an outwardly tapered conical exit section 86. The action of the extrusion die as above results in a shiny strand of continuous solder.

Figure 7:
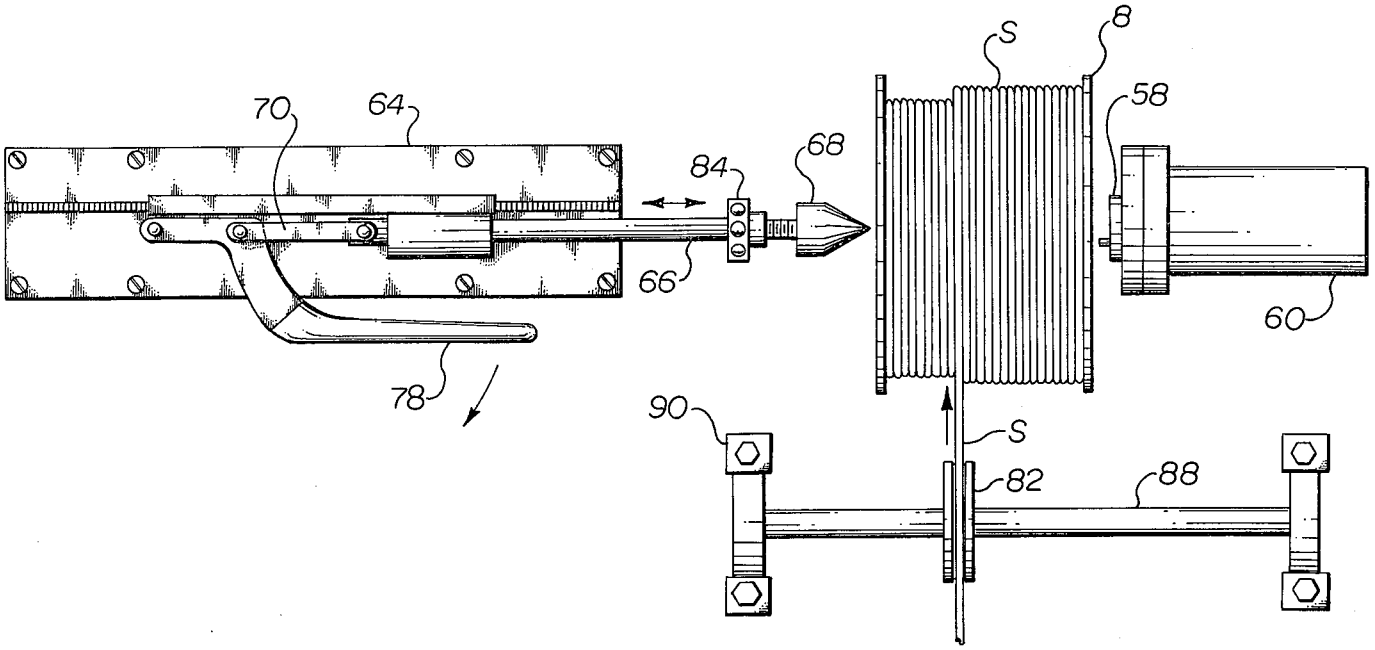
FIG. 7 is a plan view of the coiling mechanism.

Referring now to FIG. 7, the means whereby the finished strand of solder is coiled upon a spool is shown. As is shown here, the spool 8 is placed upon a driven cylindrical rod or shaft 58 connected to fluid motor 60 such that it is driven at a proper speed for coiling. A spool 8 is held in position upon the driven cylinder 58 by means of a locking mechanism which as seen is secured to base 64 and includes an outwardly extending rod 66 having mounted on the end thereof for free movement a contact head 68 which locks against the end of the spool and holds it onto the rotating cylinder 58. It is to be noted that the conical head 68 is mounted upon the rod 66 by means of a bearing structure 84 which allows relative rotation therebetween. The handle 78 is secured to a toggle mechanism which allows the rod 66 to be selectively moved inwardly, toward and outwardly away from the end of the spool 8. Further to be seen in this view is a guiding pulley 82 mounted for easy movement along rod 88 secured to brackets 90. As the solder S is fed onto the spool 8 the guide pulley 82 moves along the rod 88 allowing a tight attractive and usable completed coil.

Figure 8:
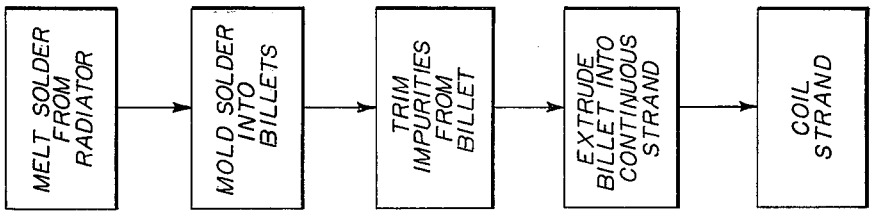
FIG. 8 is a block flow diagram for the present method.

Referring now to FIG. 8 a schematic flow diagram of the method is shown. As noted in this view and as previously explained the operator melts or otherwise removes solder from the radiator which must be repaired, and for reasons of efficiency lets the solder fall to the floor. Following a full day of operation or whenever it is necessary to clean the floor, the particles of solder are swept up along with any other debris that may be on the floor. The solder is placed into a melting pot whereat it is heated to the melting temperature and poured into billets. As the solder cools and hardens into the billets the impurities float to the top where they form a layer of impure solder. The billet, when cooled, is taken to a trimmer at which time the impurities which are trimmed from the top of the billet are discarded. The trimmed billet is then placed within the extruder and extruded into a continuous strand of solder which is fed over a plurality of pulleys and spooled onto a spool at the same rate as it is extruded.

Thus as can be readily seen the present invention provides a novle method and means for recovering solder from a radiator repair shop. The method is simple and inexpensive yielding exceptional results. The apparatus which is designed for use in a low volume operation is simple and because of its operation is unique in that it incorporates means and structure to allow the cost to be kept at an absolute minimum. Further, the several pieces of apparatus are operated simultaneously and the extrusion portion, because of its unique design generates adequate force, is compact, resulting from the flat at the top of the rod, and is simple to use.

What is claimed is:

1. An extruding mechanism adapted for use in insulations having limited space, comprising:

a. a first rigid member having a bore therethrough, b. a second rigid member, spaced from and parallel to the first rigid member, c. rigid means extending between and interconnected with the first and second rigid means, maintaining them in a fixed relative position, die chamber means and die means fixedly secured to the first rigid means whereby material extruded through the dye will pass without impedance through the bore, d. a pair of trunnion blocks secured to the second rigid member, said trunnion blocks have identical oblong bores extending therethrough, and ram means including trunnions pivotly received in the trunnion blocks blocks between the first and second rigid members, said ram means including a planar surface which is in contact with the second rigid member during extrusion thereby relieving the trunnions of such strain locatable in a position coaxial with the die chamber whereby the ram contact a billet within the die chamber and extrude the solder through the die and the bore through first rigid member.

2. An extrusion mechanism as in claim 1, wherein the ram includes a substantially planar surface which abuts the second rigid member during extrusion thereby relieving the trunnions of strain.

3. An extruding mechanism adapted for use in installations having limited space comprising:

a. a first rigid member having a bore therethrough, b. a second rigid member, spaced from and parallel to the first rigid member, c. rigid means extending between and interconnected with the first and second rigid members, maintaining them in a fixed relative position, d. open ended die chamber means to accept elongated billets of material to be extruded and die means fixedly secured to the first rigid means whereby material extruded through the die will pass without impedance through the bore, e. a pair of trunnion blocks secured to the second rigid member, said trunnion blocks have identical oblong bores extending therethrough to prevent movement during extrusion, and f. ram means including trunnions received in the trunnion blocks between the first and second rigid members, said ram means pivotable about an axis extending through the trunnions from a first position coaxial with the die chamber whereby the ram will contact a billet within the die chamber and extrude the solder through the die and the bore through the first rigid member to a second position at an angle to the first position, said second position leaving the open end of the die chamber unobstructed for insertion of a billet.

4. An extrusion mechanism as in claim 3 and further including a handle means to move the ram means from the first to the second position and including stop means to assure correct axial positioning in the first position.

* * * * *